US005125882A

United States Patent [19]

La Mothe et al.

[11] Patent Number: 5,125,882

[45] Date of Patent: Jun. 30, 1992

[54] RESISTANCE EXERCISING APPARATUS FOR STRENGTHENING A GOLF SWING

[76] Inventors: Ted A. La Mothe, 5512 45th Avenue South, Minneapolis, Minn. 55417; Larry J. Forster, 1011 Mimosa Drive; Rte. 2, Box 126 C, Anadarko, Okla. 73005

[21] Appl. No.: 552,444

[22] Filed: Jul. 13, 1990

[51] Int. Cl.[5] ..... A63B 69/00; A63B 21/00

[52] U.S. Cl. ..... 482/114; 273/193 A

[58] Field of Search ..... 272/131, 132; 273/183 A, 183 B, 186 R, 186 A, 186 C, 189 R, 191 A, 197 R, 190 R, 197 B, 191 R, 193 B, 194 B, 187 A, 193 A, 32 B, 35 R, 35 B

[56] References Cited

U.S. PATENT DOCUMENTS

| | | | |
|---|---|---|---|
| 1,621,120 | 3/1927 | Lee | 272/132 X |
| 2,472,065 | 6/1949 | Cottingham | 273/191 R |
| 3,415,523 | 12/1968 | Boldt | 273/191 R |
| 3,444,729 | 5/1969 | Shobeat | 273/191 R |
| 3,614,108 | 10/1971 | Garten | 273/191 R |
| 4,580,786 | 4/1986 | Chipley . | |
| 4,583,740 | 4/1986 | Ohly . | |
| 4,984,801 | 1/1991 | DeBack | 273/186 A |

*Primary Examiner*—Richard J. Apley
*Assistant Examiner*—Glenn E. Richman
*Attorney, Agent, or Firm*—Palmatier & Sjoquist

[57] ABSTRACT

The present resistance exercising apparatus for strengthening a golf swing includes a golf club swingably connected to a telescoping shaft. The telescoping shaft in turn is axially connected to a wheel which is mounted in a frame transversely of the golf club. The wheel engages a set of four rollers which bring pressure to bear on the wheel to create resistance to rotation of the wheel. The rollers are mounted in half-moon housings and drawable to or away from the wheel to increase or decrease the resistance to rotation of the wheel. Accordingly, the resistance apparatus may be set for a quicker golf swing with little resistance or a slower golf swing with greater resistance.

25 Claims, 5 Drawing Sheets

RESISTANCE EXERCISING APPARATUS FOR STRENGTHENING A GOLF SWING

The present invention relates to exercising apparatus and, more particularly to resistance exercising apparatus for strengthening golf swings.

BACKGROUND OF THE INVENTION

A golfer may improve his or her performance on the golf course by working on his or her driving, chipping or putting. According to many golfers, driving is the most important aspect of the game.

A long and accurate drive may be the result of proper coordination of the arms, wrists, legs and head. It may also be the result of the quickness of the swing and of brut strength.

The prior art includes the Shipley U.S. Pat. No. 4,580,786 and the Ohly U.S. Pat. No. 4,583,740. The Shipley patent discloses a device for controlling a golf swing that may be used during practice of full strength swings without significantly affecting the users hitting power. According to the Shipley patent, the apparatus creates no feeling of weight other than that of the club itself.

The Ohly patent discloses a golf swing muscle training device consisting of a tubular guide for directing a golf club during the proper swing, and a modified golf club with a weight mounted between two springs on said club. The weight of the golf club is removable and may be varied depending upon the user's desired amount of weight. Sufficient clearance is allowed between the weight and the sides of the guides. The purpose of the weights is to exercise and build the pertinent muscles necessary for an effective and strong golf stroke.

SUMMARY OF THE INVENTION

A feature of the present invention is the provision in a golf exercising apparatus, of a golf club being swingably connected to an intermediate shaft which in turn is swingably connected to a resistance creating means affixed transversely of the golf club for creating resistance when the golf club is swung.

Another feature is the provision in such a golf exercising apparatus, of a telescoping intermediate shaft that is extended and retracted during the course of the golf swing.

Another feature is the provision in such a golf exercising apparatus, of a wheel that is rotated by the swinging of the golf club, and pressure bearing means engaging and bringing pressure to bear on the wheel to create resistance to the rotation of the wheel, and accordingly, resistance to the swinging of the golf club.

Another feature is the provision in such a golf exercising apparatus, of means for adjusting the pressure brought by the pressure bearing means such that resistance to the rotation of the wheel is increasable and decreasable.

Another feature is the provision in such a golf exercising apparatus, of the pressure bearing means including a set of four rollers for engaging and bringing pressure to bear on the rim of the wheel to create resistance to the rotation of the wheel.

An advantage of the present invention is that the appropriate muscles for the swinging of a golf club are exercised. The resistance exercising apparatus permits a natural swinging of a golf club.

Another advantage is that the strength of a golfer's swing is improved.

Another advantage is that the quickness of a golfer's swing is improved.

Another advantage is that the form and technique of the swing may be improved. With resistance on the swing, a golfer has more time to think about and make corrections to his form. The apparatus may also constrain the golfer's swing such that the golf club is swung through only a proper arc.

Another advantage is that a range of exercising is provided by the resistance exercising apparatus. When the rollers are set to create only slight resistance, the golf club may be swung a number of times for a complete workout. With maximum resistance on the wheel, a relatively few swings of the golf club may provide a complete workout.

Another advantage is that the resistance exercising apparatus is sufficiently compact in one form to fit in the trunk of a car.

Another advantage is that the resistance exercising apparatus is simple to manufacture and operate.

DESCRIPTION OF THE PREFERRED EMBODIMENTS

Figure 9:
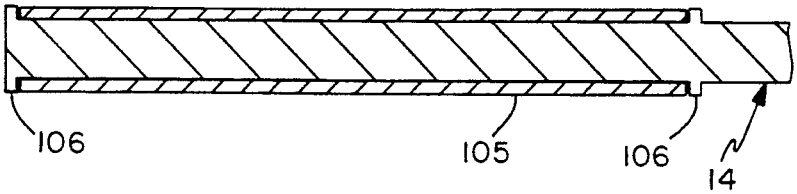
FIG. 9 is a section view at lines 9—9 of FIG. 1.
Figure 1:
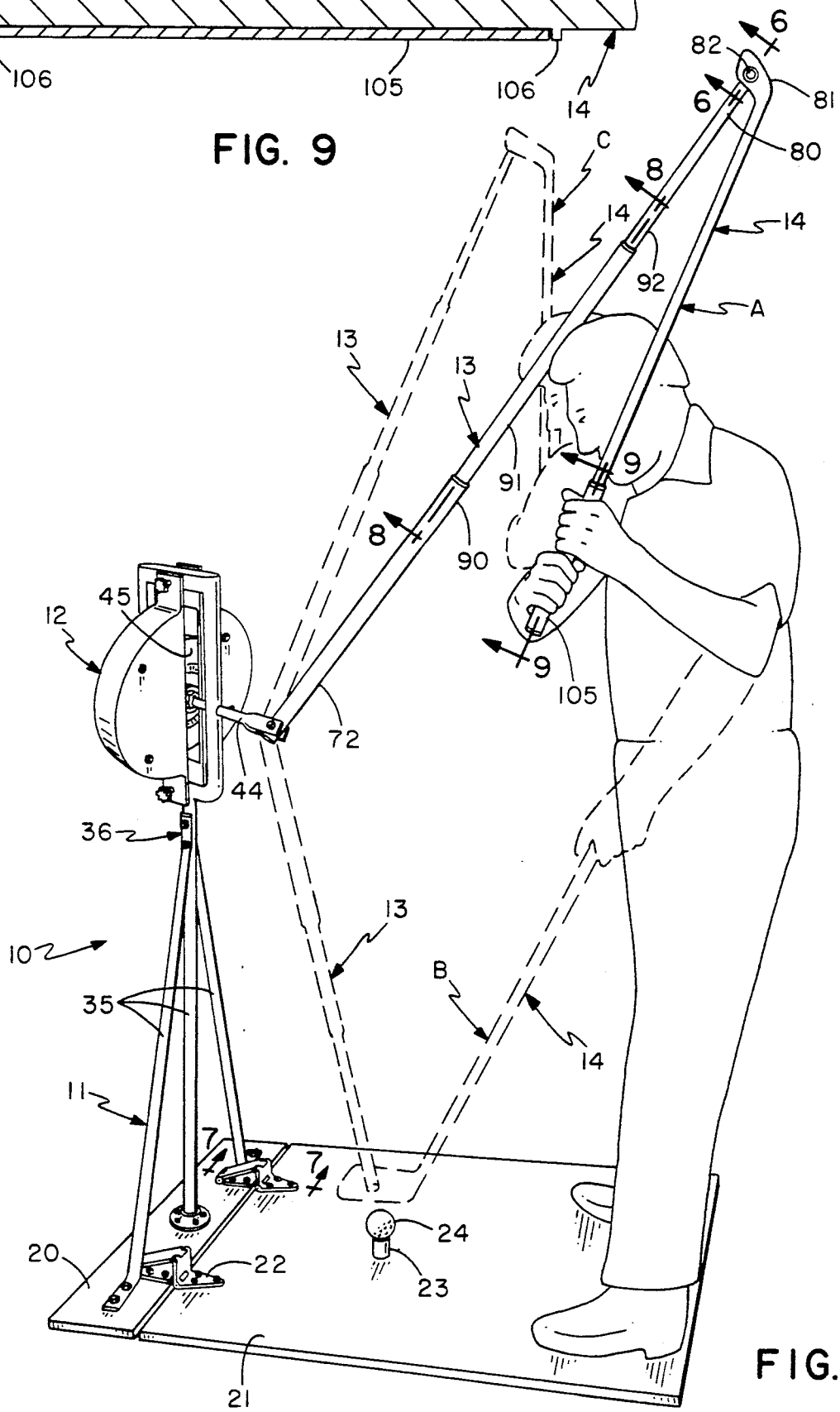
FIG. 1 is a perspective, partially phantom view of the resistance exercising apparatus in operation.
Figure 2:
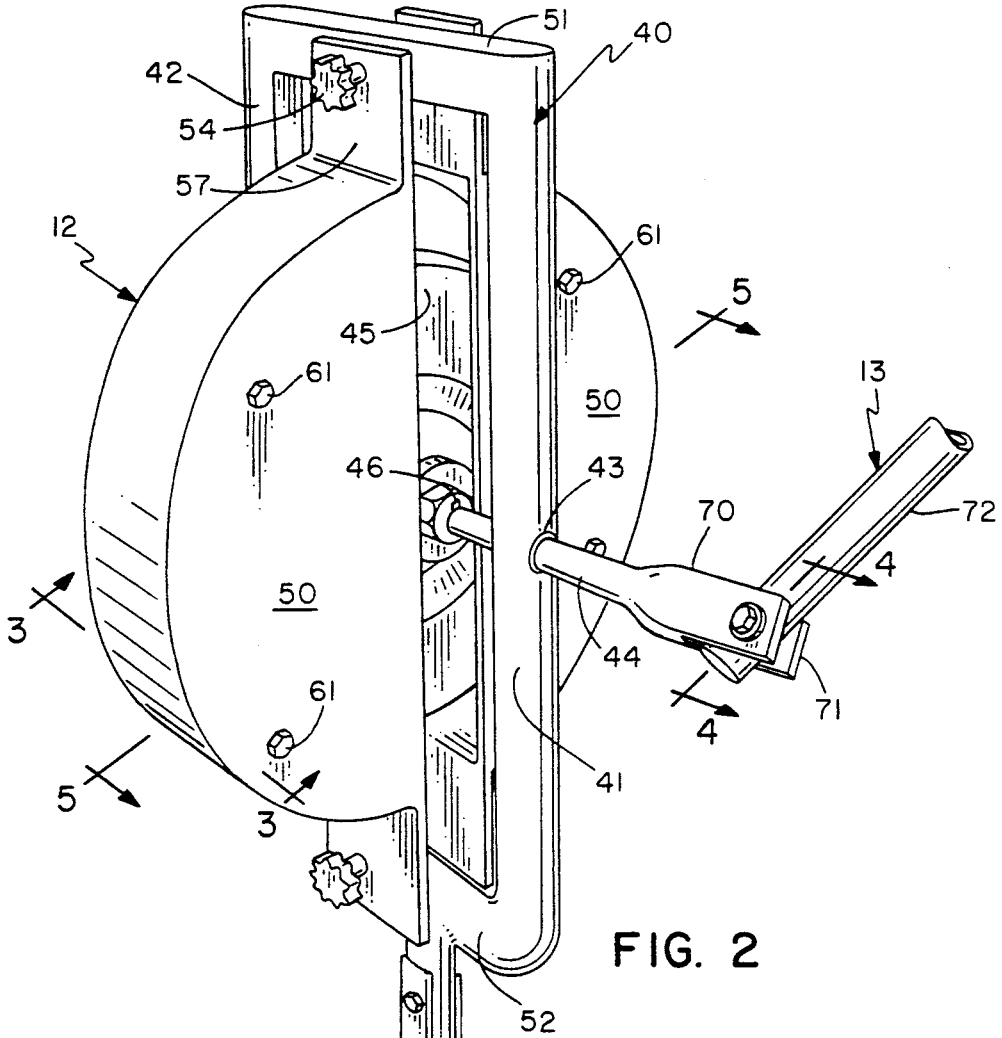
FIG. 2 is a detail of elevation view of a portion of the apparatus in FIG. 1.
Figure 3:
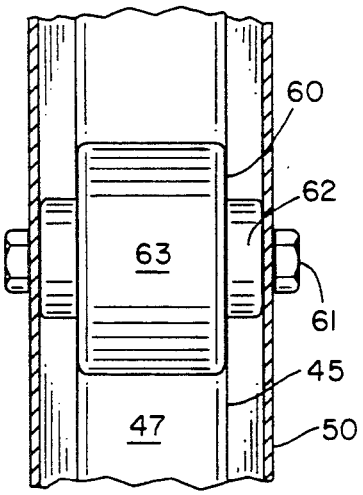
FIG. 3 is a section view at lines 3—3 of FIG. 2.
Figure 4:
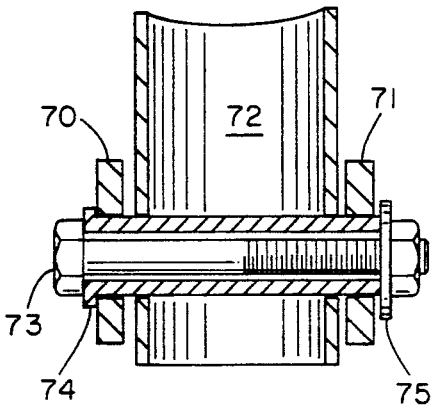
FIG. 4 is a section view at lines 4—4 of FIG. 2.
Figure 5:
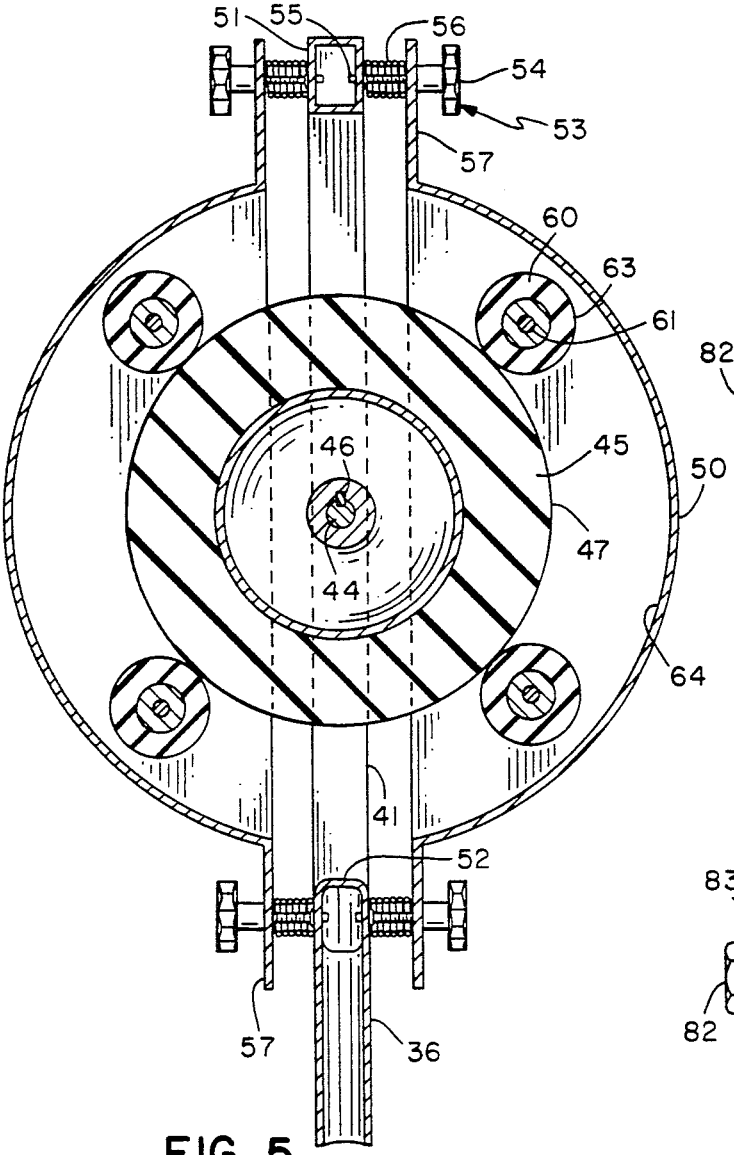
FIG. 5 is a section view at lines 5—5 of FIG. 2.

As shown in FIG. 1, the present resistance golf exercising apparatus is indicated in general by the reference numeral 10. It includes as its principal components a support 11, a resistance creating means 12, an extendable shaft 13, and a golf club 14. Resistance to the swinging of the golf club 14 is created by the resistance creating means 12.

Figure 7:
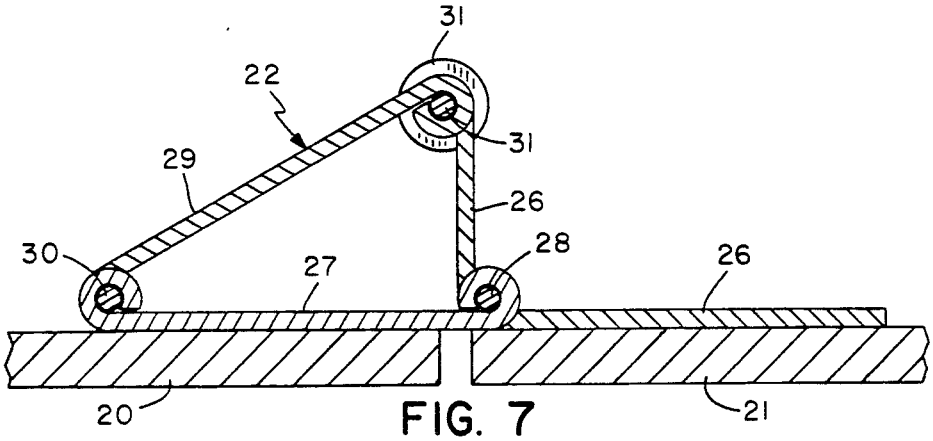
FIG. 7 is a section at line 7—7 of FIG. 1.

As shown in FIG. 1, the support 11 includes a base 20 hingedly connected to a platform 21 via hinges 22. A tee 23 formed of rubber hosing mounts a golf ball 24 on a central portion of the platform 21. As shown in FIG. 7, each of the hinge's 22 includes a right-angled bracket 26 screwed to the platform 21, a plate 27 screwed to the base 20 and pivotally connected via a hinge pin 28 to the bracket 26, and an oblique extending plate 29. The plate 29 is pivotally connected to plate 27 via a hinge pin 30 and to the bracket 26 via a removable hinge pin 31. The hinge 22 rigidly connects the base 20 to the platform 21 and supports the resistance creating means 12 relative to the platform 21. When the pin 31 is removed from the bracket 26 and plate 29, the plate 29 is swingable upwardly and away from bracket 26 to rest on the surface of the base 20. Subsequently, the platform 21 is swingable upwardly and toward the resistance creating means 12 such that the resistance exercising apparatus 10 creates a compact form for storage in, for example, the trunk of a car.

The support 11 further includes a set of three metal, support tubes 35 secured to the base 20. The middle tube 35 may include an extendable portion 36 to raise or lower the resistance creating means 12, although typically such an extendable portion 36 is not preferred since the extendable shaft 13 accommodates golfers of different heights.

The resistance creating means 12 includes a rectangular tubular integral frame 40 mounted on the support tubes 35. Side members 41, 42 of the frame 40 include bearings 43 for guiding and reducing the friction of rotation of an axle 44 through the side members 41, 42. The axle 44 mounts a wheel 45 which is keyed to the axle 44 with a key 46. The wheel 45 includes a circumferential cuter surface or rim 47. The wheel 45 is rotatable by a swinging of the shafts 13, 14 and is typically somewhat massive.

The axle 44 further includes a pair of collars 48 with set screws 49. Each of the collars 48 is disposed immediately inside of its respective side member 41, 42. The collars 44 prevent a longitudinal slippage of the axle 44 relative to the side members 41, 42, of the frame 40.

A pair of half-moon housings 50 surround portions of the wheel 45 and are mounted to upper and lower frame members 51, 52 via a set of four adjustment pin connectors 53. Each of the pin connectors 53 includes a knob 54 fixed to an end of one of the threaded pin connectors 53 cooperating with one of the upper and lower frame members 51, 52. A coil spring 56 is disposed between one of the frame members 51, 52 and a flat portion 57 of one of the housings 50 for biasing the housings 50 outwardly.

Each of the housings 50 rotatably mounts a pair of rollers 60 for engaging the wheel 45. Each of the rollers 60 is mounted in its respective housing 50 by a pin connector 61 and a pair of bushings 62 disposed on each of the sides of the rollers 60 and the inner flat vertically disposed surface of the housing 50. Each of the rollers 60 includes a circumferential outer surface or rim 63 for engaging in bringing pressure to bear on the rim 47 of the wheel 45. The width of the rims 47, 63 are substantially equal. The rim 63 of each of the rollers 60 is spaced from an inner circumferential surface 64 of each of the housings 50.

Resistance to rotation of the wheel 45 is created by turning the knob 54 of at least one of the pin connectors 53 to draw in one of the rollers 60 of one of the housings 50. As the housing 50 and roller 60 is drawn inwardly toward a plane defined by frame members 41, 42, the rim 63 of the roller 60 engages and brings pressure to bear on the rim 47 of the wheel 45 to create a resistance to the rotation of the wheel 45. One or more of the pin connectors 53 may be operated to adjust the pressure and hence resistance on the wheel 45. Typically, the rollers 60 are spaced at approximately 90° arcs from each other to distribute pressure evenly about the wheel 45.

It should be noted that the roller 60 may be drawn out of engagement with the wheel 45 to minimize resistance to rotation of the wheel 45. The coil springs 56 urge the flat portions 57 and housings 50 outwardly when the knob 54 is loosened. At the other extreme, the knobs 54 may be turned to draw in the roller 60 so tightly against the wheel 45 so as to maximize resistance to rotation of the wheel 45. The roller 60 may be adjusted at increments between the extremes to provide a range of exercising resistance.

It should also be noted that resistance to rotation of the roller 60 may be created by adjustment of pin connectors 61. Such pin connectors 61 may be tightened to pinch the roller 60 between the bushings 62 and hence create resistance to rotation of the roller 60, as well as resistance to rotation of the wheel 45.

The axle 44 is integrally formed with a pair of bars 70, 71 extending axially from the axle 44 and wheel 45. The bars 70, 71 are pivotally connected to axial end portion 72 of the extendable shaft 13 via a pin connector 73. A rotatable bushing 74 is disposed about the stem of the pin connector 73. One or more washers 75 may be disposed on the pin connector 73 to minimize wobbling of the shaft 13 relative to, and into the planes defined by, the axle bars 70, 71, while maintaining a free pivotal movement of the shaft 13 diametrically of the wheel 45. A swinging of the shaft 13 axially about the axle 44 and wheel 45 causes a rotation of the wheel 45 and a rotation of the rollers 60.

Figure 6:
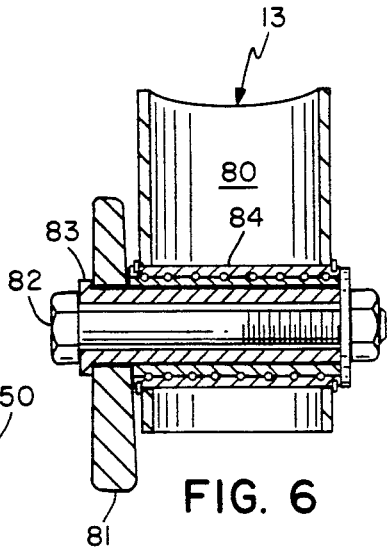
FIG. 6 is a section view at lines 6—6 of FIG. 1.
Figure 6A:
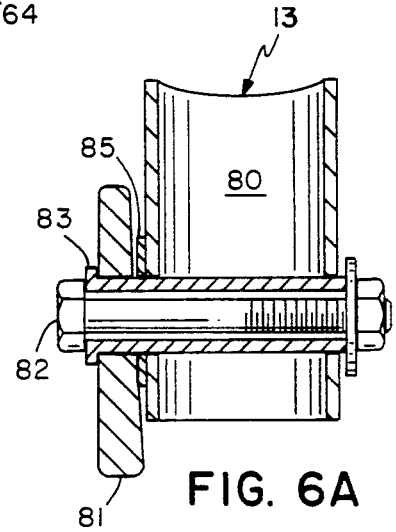
FIG. 6A is a section view of an alternate embodiment of the bushing of FIG. 6.

The extendable shaft 13 includes the axial end portion 72 and an outer, extendable end portion 80. The outer end portion 80 is pivotally connected to a club head or distal portion 81 of the golf club 14 via a pin connector 82. The pin connector 82 rides in a rotatable bushing 83 which in turn rides in a ball bearing 84. As shown in FIG. 6A, one or more washers 85 may be disposed between the club head 81 and the outer end portion 80 to minimize a wobbling of the club head 81 relative to the outer end portion 80 and shaft 13 while allowing a free pivotal movement between the shaft 13 and the golf club 14.

Figure 8:
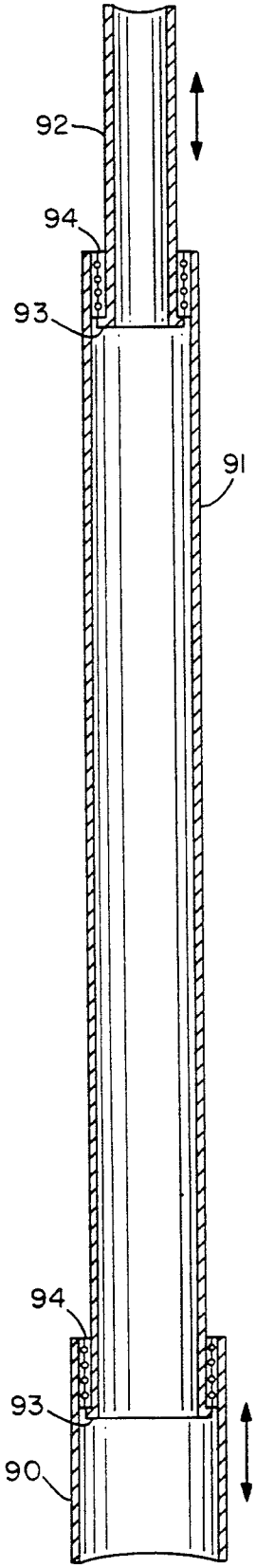
FIG. 8 is a section view at lines 8—8 of FIG. 1.

The extendable shaft 13 further includes a set of three telescoping portions 90, 91, 92. Outer portion 92 slides in portion 91 which in turn slides in portion 90. As shown in FIG. 8, each of the telescoping portions 90, 92 includes an inner annular lip 93 for abutting in its fully extended position a ball bearing 94, which rotatably mounts the portions 91 and 92 in their respective portions 90 and 91. Typically, middle portion 91 is greater in length than portion 90 such that portion 91 is not fully retractable into portion 90.

Figure 8A:
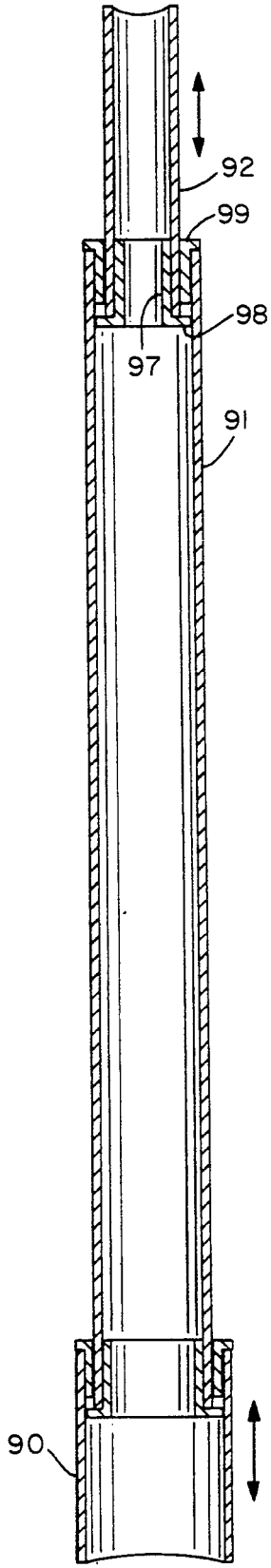
FIG. 8A is a section view of an alternate embodiment of the shaft of FIG. 8.
Figure 8B:
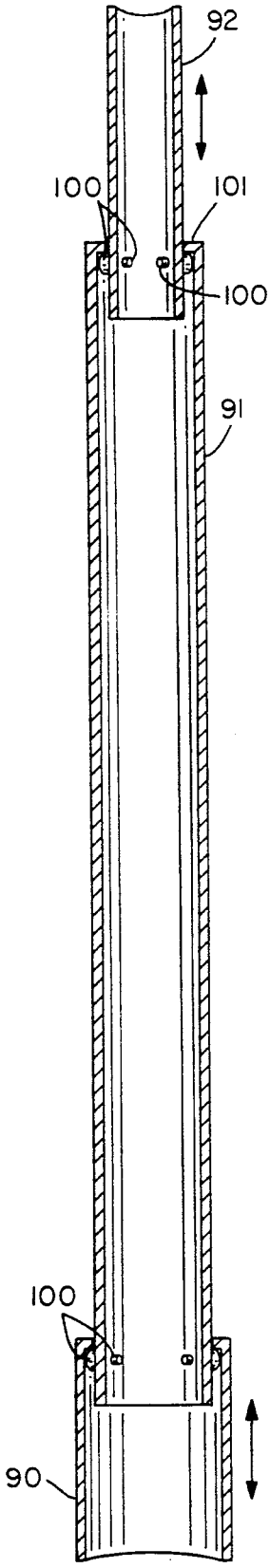
FIG. 8B is a section view of another alternate embodiment of the shaft of FIG. 8.

FIG. 8A shows alternate telescoping connections including an inner bushing 97 with an annular lip 98, and an outer bushing 99. Inner bushing 97 is fixed to portion 92 and outer bushing 99 is fixed to portion 91. FIG. 8B shows set screws 100 for bearing against inwardly extending annular lips 101 of respective portions 90, 91. In each of the embodiments, the portions 91, 92 are rotatable relative to each other, and portion 91 is rotatable relative to portion 90.

The golf club or hand-held shaft 14 includes a club head 81 on a distal portion of the shaft 14. It also includes a gripping, proximal, rotatable portion 105 opposite the club head 81. The pivotal gripping portion 105 is held in place via integral annular stops 106 disposed on either end of the gripping portion 105. The rotatable gripping portion 105 allows a rotation of the shaft 14 relative to the gripping portion 105 and the hands of a golfer.

In operation, to set up the resistance exercising apparatus 10 from its compact form, the platform 21 and base 20 are placed on a floor and the removable pin 31 is inserted into the aligned portions of plate 29 and bracket 26. A ball 24 may be disposed on the tee 23 so that the golfer feels the point in his or her swing at which ball contact is made. Typically, the exercising apparatus 10 is used without a ball because one purpose of the apparatus 10 is to exercise by swinging the golf club 14 a number of times over five to fifteen minutes or more. After the base 20 and platform 21 are secured to each other, the prescribed resistance on the wheel 45 is set by turning the knobs 54 so that one or more of the rollers 60 engage and bring pressure to bear on the wheel 45.

Over the course of the swing, the shaft 13 is extended at the height of a back swing A, as shown in FIG. 1. From the height of the back swing A to the point at which contact is made with the ball 24, as denoted by reference character B, the shaft 13 is retracted via the sliding telescoping portions 90, 91, 92 and resistance to the swinging of the shafts 13, 14 is created by the roller 60 engaging the wheel 45, which is rotated by the swinging of the shafts 13, 14. From point B, at which ball contact is made, to the height of the follow-through swing at location C, the shaft 13 is extended as the telescoping portions 91, 92 slide outwardly, and resistance to the swinging of the shafts 13, 14 continues as the rollers 60 maintain contact with the wheel 45. Such a process is then reversed and may be repeated a plurality of times over a few minutes to build strength in and quicken a golf swing.

It should be noted that over the course of the golf swing, the angle between the shafts 13 and 14 changes, and is allowed to change via the pivotal pin connector 82. Likewise, the angle between shaft 13 and axle 44 changes, and is permitted to change via the pivotal pin connector 73.

It should also be noted that over the course of a swing, axial rotation of telescoping portions 91 and 92 may occur relative to each other and relative to telescoping portion 90. Although typically rotation of the club head 81 relative to shaft 13 is minimal when a golfer swings a club 14, the shaft 13 permits such rotation. Furthermore, rotation of the hand-held gripping portion 105 may occur relative to the shaft 14 over the course of the swing.

Figure 10:
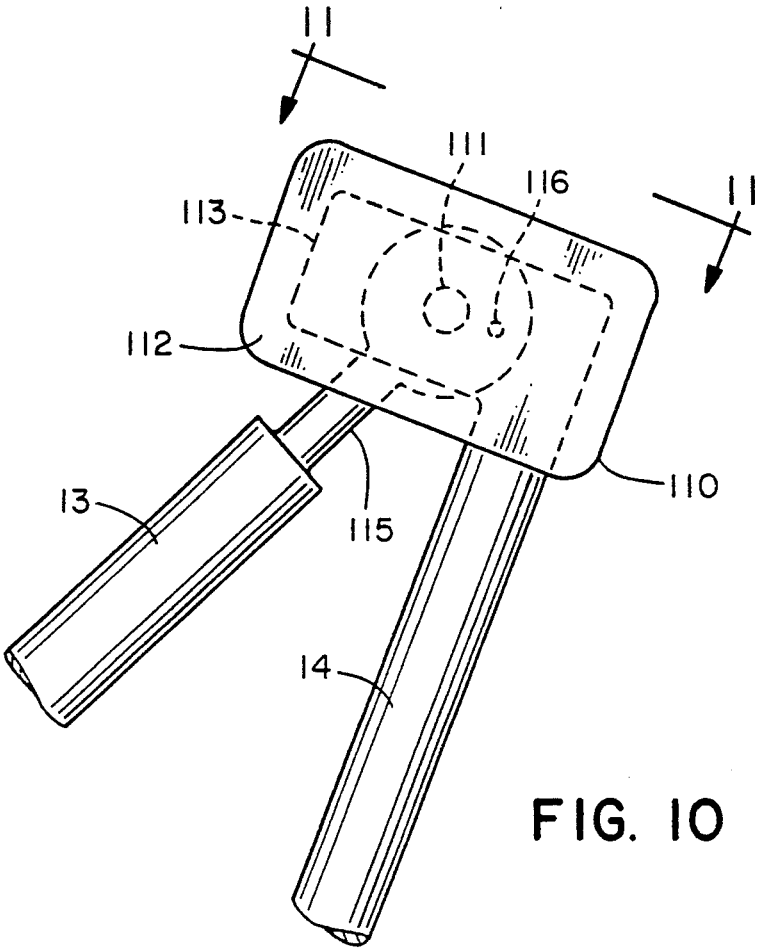
FIG. 10 is a detail, partially phantom, elevation view of an alternate embodiment of the golf and telescoping shafts.
Figure 11:
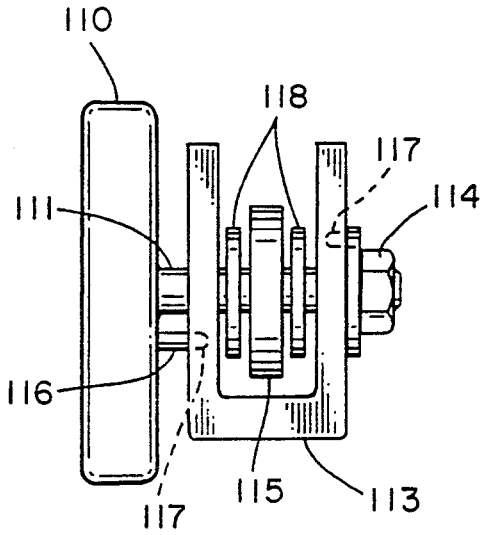
FIG. 11 is a view at lines 11—11 of FIG. 10.

As shown in FIGS. 10 and 11, an alternate embodiment accommodates both right-handed and left-handed golfers. It includes a removable golf club head 110 with an integral pin 111 to provide a ball-hitting face 112 to the head 110. The shape of the head 110 is somewhat rectangular for symmetry so that both right-handed and left-handed may utilize the same club head. The club head 110 is securable to either side of a forked extension 113. The integral pin 111 extends through the apertured forked extension 113 integrally extending from the golf club shaft 14 and is secured to the forked extension with a nut 114. The integral pin 111 also extends through a solid, narrowed extension 115 of the telescoping shaft 13. The integral pin 111 is paired with a second pin 116 which cooperates with one of two holes 117 on either side of the forked extension 113 to prevent rotation of the club head 110. Washers 118 on the integral pin 111 at certain positions prevent a wobbling of the shafts 13, 14 relative to each other, but permit a pivotal movement therebetween.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A resistance exercising apparatus for strengthening a golf swing, comprising:

a hand-held shaft with proximal and distal portions and having a length approximately equal to a conventional golf club such that the distal portion is swingable adjacent to the ground;

an extendable shaft with inner and outer portions being freely slidable relative to each other throughout the arc of the golf swing, the outer portion being swingably affixed to the distal portion of the hand-held shaft, the extendable shaft being extendable in length and swingable with the hand-held shaft when the hand-held shaft is swung through an arc of the golf swing;

a support mounted transversely of the hand-held and extendable shafts; and resistance creating means on the support and being affixed to the inner portion of the extendable shaft for creating resistance to the swinging of the hand-held and extendable shafts, the extendable shaft swinging about an axis of the resistance creating means and also about an axis which is generally perpendicular to the axis of the resistance creating means.

2. The apparatus of claim 1, wherein the resistance creating means comprises rotatable means which is rotated by the swinging of the shafts, and pressure bearing means for engaging and bringing pressure to bear on the rotatable means such that resistance to rotation of the rotatable means is created.

3. The apparatus of claim 2, wherein the pressure bearing means comprises rotation means bearable against a portion of the rotatable means to create the resistance to rotation of the rotatable means.

4. The apparatus of claim 2, wherein the resistance creating means comprises means for adjusting the pressure of the pressure tearing means to increase or decrease the pressure on the rotatable means such that resistant to rotation of the rotatable means is adjustable.

5. The apparatus of claim 2, wherein the rotatable means includes a wheel with a rim and the pressure bearing means engages the rim to create the resistance to rotation of the rotatable means.

6. The apparatus of claim 3, wherein the rotation means includes a roller with a rim, the rim being bearable against a portion of the rotatable means to create the resistance to rotation of the rotatable means.

7. The apparatus of claim 2, wherein the rotatable means includes a wheel with a rim, and the pressure bearing means engages the rim at a set of at least two spaced apart locations.

8. The apparatus of claim 2, wherein the rotatable means includes as wheel with a rim, and the pressure bearing means engages the rim at a set of at least four spaced apart locations.

9. The apparatus of claim 2, wherein the rotatable means comprises a wheel with a rim, and the pressure bearing means comprises a roller with a rim, the rim of the roller engaging and bringing pressure to bear on the rim of the wheel such that resistance to rotation of the wheel is created.

10. The apparatus of claim 1, wherein the extendable shaft includes at least two portions that are axially rotatable relative to each other.

11. The apparatus of claim 1, wherein the extendable shaft comprises at least two telescoping portions.

12. The apparatus of claim 1, wherein the hand-held shaft comprises at least two portions that are axially rotatable relative to each other.

13. The apparatus of claim 1, wherein the hand-held shaft includes a removable club head mountable on opposing portions of the hand-held shaft to accommodate both right-handed and left-handed golfers.

14. A resistance exercising apparatus for strengthening a golf swing, comprising:

a hand-held shaft with proximal and distal portions and having a length approximately equal to a conventional golf club such that the distal portion is swingable adjacent to the ground;

an intermediate shaft with inner and outer portions, the outer portion being swingably affixed to the distal portion of the hand-held shaft, the intermediate shaft being swingable with the hand-held shaft when the hand-held shaft is swung through an arc of the golf swing;

a support mounted transversely of the hand-held and intermediate shafts; and resistance creating means on the support for creating resistance to the swinging of the hand-held and intermediate shafts and comprising a wheel and pressure bearing means for engaging and bringing pressure to bear on the wheel such that resistance to rotation of the wheel is created, the wheel including attachment means axially affixed to the inner portion of the intermediate shaft and being rotated by the swinging of the shafts, whereby the intermediate shaft is swingable about the axis of the wheel and also about an axis which is generally perpendicular to the axis of the wheel.

15. The apparatus of claim 14, wherein the wheel includes a rim, and the pressure bearing means engages the rim at a set of at least two spaced apart locations on the rim to crate resistance to rotation of the wheel.

16. The apparatus of claim 14, wherein the wheel includes a rim, and the pressure bearing means engages the rim at a set of at least four spaced apart locations on the rim to create resistance to rotation of the wheel.

17. The apparatus of claim 14, wherein the pressure bearing means comprises a roller engageable with the wheel.

18. The apparatus of claim 16, wherein the pressure bearing means comprises a set of four rollers, each of the rollers engageable with the wheel at one of the four spaced apart locations.

19. The apparatus of claim 14, wherein the intermediate shaft includes at least two telescoping portions being extendable relative to each other.

20. The apparatus of claim 14 wherein the intermediate shaft includes at least two portions being axially rotatable relative to each other.

21. The apparatus of claim 14, wherein the hand-held shaft includes at least two portions that are axially rotatable relative to each other.

22. The apparatus of claim 14, wherein the hand-held shaft includes a removable club head mountable on opposing portions of the hand-held shaft to accommodate both right-handed and left-handed golfers.

23. A resistance exercising apparatus for strengthening a golf swing, comprising:

a golf club with a proximal gripping portion, a distal portion including a club head, and having a length approximately equal to a conventional golf club such that the distal portion is swingable adjacent to the ground, the gripping portion being axially rotatable relative to the distal portion;

a telescoping shaft with inner and outer portions, the outer portion being pivotally affixed to the distal portion of the golf club, the telescoping shaft being extendable in length and swingable with the golf club when the golf club is swung through an arc of the golf swing, the portions being axially rotatable relative to each other;

a support mounted transversely of the golf club and telescoping shafts and including a frame;

a wheel with a rim and an axle and being rotatably mounted in the frame, the axle being pivotally connected to the inner portion of the telescoping shaft such that the wheel is rotated by the swinging of the shafts;

a pair of housings being shaped to fit about portions of the wheel, each of the housings being adjustable affixed to the frame such that each of the housings is drawable to and away from the wheel; and a set of four rollers with two of the rollers rotatably mounted in one of the housings and the other two rollers being rotatably mounted in the other housing, each of the rollers having a rim, the rims of the rollers being engageable with and brining pressure to bear upon the rim of the wheel to create resistance to rotation of the wheel, the pressure of the rollers on the wheel being adjustable when the housings are drawable to or away from the wheel to adjust the resistance to rotation of the wheel whereby resistance is created when the golf club is swung through the arc of the golf swing.

24. The apparatus of claim 1, wherein the outer portion of the extendable shaft pivots relative to the hand-held shaft about an axis which is generally perpendicular to a longitudinal axis of the extendable shaft.

25. A resistance exercising apparatus for strengthening a golf swing, comprising:

a hand-held shaft with proximal and distal portions and having a length approximately equal to a conventional golf club such that the distal portion is swingable adjacent to the ground;

an intermediate shaft with inner and outer portions, the outer portion being affixed to the hand-held shaft, the intermediate shaft being swingable with the hand-held shaft when the hand-held shaft is swung through an arc of the golf swing;

a support mounted transversely of the hand-held and intermediate shafts; and resistance creating means on the support for creating resistance to the swinging of the hand-held and intermediate shaft and comprising a wheel with a rim and pressure bearing means for engaging and bringing pressure to bear on the rim of the wheel such that resistance to rotation of the wheel is created, the pressure bearing means comprising a roller with a rim, the rim of the roller engaging and bringing pressure to bear on the rim of the wheel such that resistance to rotation of the wheel is created, the wheel being axially affixed to the inner portion of the intermediate shaft and being rotated by the swinging of the shafts.

* * * * *

UNITED STATES PATENT AND TRADEMARK OFFICE

CERTIFICATE OF CORRECTION

PATENT NO. : 5,125,882

DATED : June 30, 1992

INVENTOR(S) : Ted A. LaMothe and Larry J. Forster

It is certified that error appears in the above-identified patent and that said Letters Patent is hereby corrected as shown below:

Column 3, line 22, delete "cuter" and replace it with --outer--.

Column 6, line 41, delete "tearing" and replace it with --bearing--.

Signed and Sealed this

Twenty-first Day of September, 1993

Bruce Lehman

*Attest:*

BRUCE LEHMAN

*Attesting Officer*

*Commissioner of Patents and Trademarks*